US005861573A

United States Patent [19]

Pickard

[11] Patent Number: 5,861,573

[45] **Date of Patent: *Jan. 19, 1999**

[54] DIVIDING BULLET WITH WEAKENED LONGITUDNAL SEAM FOR SEPARATING INTO HALVES UPON IMPACT WITH TARGET

[76] Inventor: Richard Pickard, 20505 E. Country Club Dr. Suite 335, Aventura, Fla. 33180

[ * ] Notice: The term of this patent shall not extend beyond the expiration date of Pat. No. 5,801,324.

[21] Appl. No.: 829,206

[22] Filed: Mar. 31, 1997

[51] Int. Cl.[6] ..... F42B 12/34

[52] U.S. Cl. ..... 102/506; 102/517

[58] Field of Search ..... 102/501, 502, 102/506–510, 514–518, 529

[56] References Cited

U.S. PATENT DOCUMENTS

| | | | |
|---|---|---|---|
| 90,732 | 6/1869 | Curtis | 102/91 |
| 122,620 | 1/1872 | Maduell | 102/506 |
| 221,249 | 11/1879 | Nowlan | 102/506 |
| 275,674 | 4/1883 | Littlepage | 102/506 |
| 948,148 | 2/1910 | Schenk | 102/506 |
| 1,072,880 | 9/1913 | Tewes | 102/501 |
| 2,661,694 | 12/1953 | Allen et al. | 102/91 |
| 3,097,603 | 7/1963 | Harper | 102/506 |
| 3,138,102 | 6/1964 | Meyer et al. | 102/92.5 |
| 3,282,214 | 11/1966 | Briscoe | 102/38 |
| 3,665,861 | 5/1972 | Jaslow | 102/93 |
| 4,836,110 | 6/1989 | Burczynski | 102/508 |
| 4,947,755 | 8/1990 | Burczynski | 102/506 |
| 5,528,989 | 6/1996 | Briese | 102/506 |

FOREIGN PATENT DOCUMENTS

| | | | |
|---|---|---|---|
| 3822775 | 2/1990 | Germany | 102/507 |
| 311620 | 5/1929 | United Kingdom | 102/507 |

OTHER PUBLICATIONS

Lyman Reloading Handbook for Rifle, Pistol and Muzzle Loading, 1970 pp. 246–249.

*Primary Examiner*—Harold J. Tudor
*Attorney, Agent, or Firm*—George R. McGuire

[57] ABSTRACT

A dividing bullet includes a projectile body having a longitudinal mid-plane and a pair of projectile halves. The halves are disposed on opposite sides of the longitudinal mid-plane and substantially symmetrical in relation to one another and to a longitudinal central axis of the projectile body. The dividing bullet also includes a seam extending through the projectile body formed between the halves along the longitudinal mid-plane of the projectile body. The halves are joined to one another along the seam by a joint that is weaker in strength than the material making up the pair of halves of the projectile body such that the projectile body will separate at the seam along the longitudinal mid-plane into the halves upon impact with a target.

14 Claims, 2 Drawing Sheets

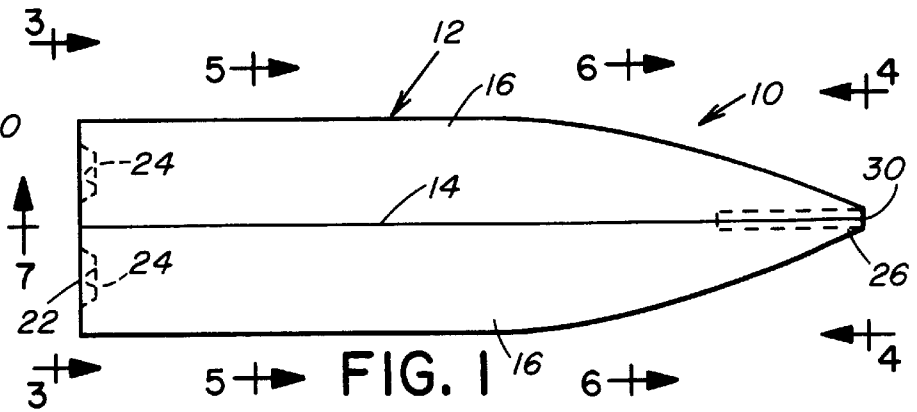
FIG. 1
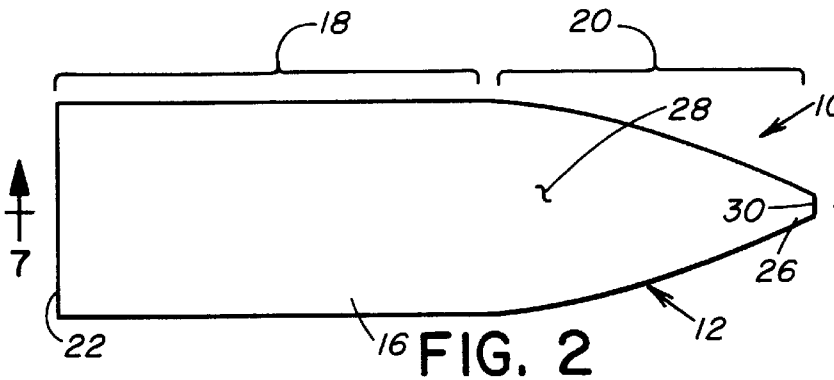
FIG. 2
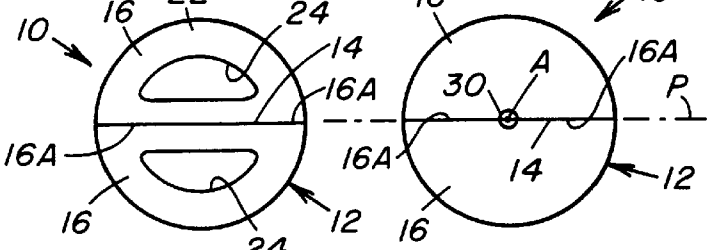
FIG. 3
FIG. 4
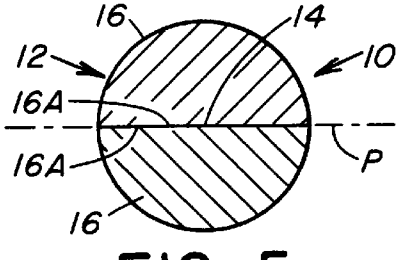
FIG. 5
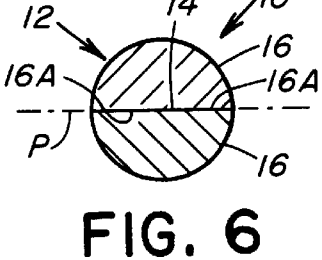
FIG. 6
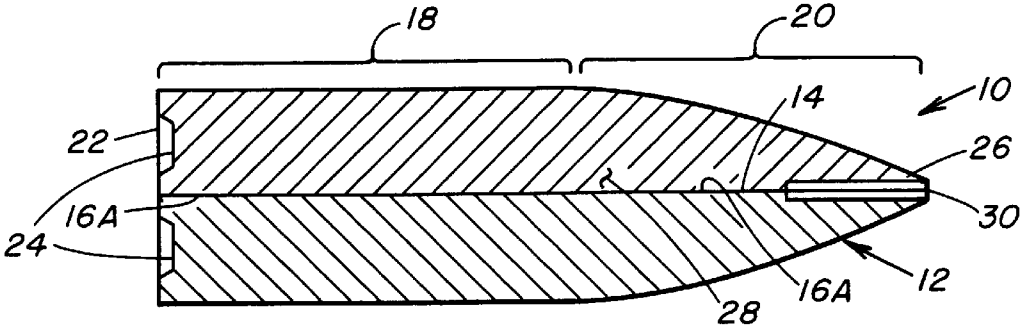
FIG. 7

DIVIDING BULLET WITH WEAKENED LONGITUDNAL SEAM FOR SEPARATING INTO HALVES UPON IMPACT WITH TARGET

CROSS-REFERENCE TO RELATED APPLICATION

Reference is hereby made to the following copending U.S. application dealing with subject matter related to the present invention: "Dividing Bullet Having Longitudinally Joined Jacketed Projectile Segments That Separate Upon Target Impact" by Richard Pickard, assigned U.S. Ser. No. 08/831,456 and filed Mar. 31, 1997.

BACKGROUND OF THE INVENTION

1. Field of the Invention

The present invention generally relates to bullet constructions and, more particularly, is concerned with a dividing bullet with a weakened longitudinal seam extending along a longitudinal mid-plane of the bullet for producing two projectile halves upon impact with a target.

2. Description of the Prior Art

A bullet for use in hunting and personal defense ideally will travel accurately in flight from the gun to the target and upon impact with the target deliver a substantial shock and then penetrate the target body creating a wound channel of substantial cross-sectional size before exiting the target. The most violent, shocking, destructive and largest wound channels are made from a large cross section perpendicular to the axis of travel within the target. Also for a bullet to be effective it must retain as much of its weight after impact as possible so that it will maintain the momentum necessary to force its way through the target to make deep penetration.

Typical conventional hunting and personal defense bullets are made with a soft lead core projectile and a copper jacket covering all but about 10% of the projectile at the tip. Upon striking the target, these bullets are designed to deform into a mushroom-shape, making a large wound channel in the target body and providing substantial impact shock. However, a drawback of the mushroom-shape deformation is that substantial fragmentation of the bullet results, for example from about 40% to 50% of the bullet weight. The small fragments or pieces of the lead and copper jacket that break away from the bullet serve no useful purpose and reduce the overall weight retention of the bullet, thereby reducing its penetration capability and in many cases causing no exit wound. Substantial penetration is necessary for the bullet to completely pass through all of the vital organs, and the exit wound is important to leave a large blood trail.

Many different bullet designs have been proposed in the prior art. Representative examples of these bullets are disclosed in U.S. Pat. No. 90,732 to Curtis, U.S. Pat. No. 122,620 to Maduell, U.S. Pat. No. 221,249 to Nowlan, U.S. Pat. No. 275,674 to Littlepage, U.S. Pat. No. 948,148 to Schenk, U.S. Pat. No. 2,661,694 to Allen et al., U.S. Pat. No. 3,097,603 to Harper, U.S. Pat. No. 3,138,102 to Meyer et al., U.S. Pat. No. 3,282,214 to Briscoe, U.S. Pat. No. 3,665,861 to Jaslow, U.S. Pat. Nos. 4,836,110 and 4,947,755 to Burczynski and U.S. Pat. No. 5,528,989 to Briese. However, it appears likely that most of these prior art bullets would meet with only limited success, if any at all, due to one or more of the following drawbacks: the multiplicity of parts forming the bullets would enhance rather than diminish their tendency toward fragmentation and achieve poor penetration; and the wedged, lopsided or asymmetrical shapes of the bullets would cause a wobbling of the bullet during flight and thus reduce bullet accuracy to the target as well as achieve poor penetration in the target.

Consequently, a need still exists for a bullet that more nearly approaches the ideal parameters set forth above by overcoming the aforementioned drawbacks of the prior art bullets without introducing new drawbacks in their place.

SUMMARY OF THE INVENTION

The present invention provides a dividing bullet with a weakened longitudinal seam extending along a longitudinal mid-plane of the bullet for producing two projectile halves upon impact with a target and which is designed to satisfy the aforementioned need. The dividing bullet of the present invention separates at its longitudinal seam without fragmentation and forms symmetrical halves which create two large wound channels through an animal or human body. The dividing bullet has a simple construction. The principle use of the dividing bullet is for hunting and self defense. The dividing bullet can be used in all modern ammunition, black powder muzzle loader rifles, handguns, shotgun slugs and all military applications.

Accordingly, the present invention is directed to a dividing bullet which comprises: (a) a projectile body having a longitudinal mid-plane and a pair of projectile halves, the halves being disposed on opposite sides of the longitudinal mid-plane and substantially symmetrical in relation to one another and to a longitudinal central axis of the projectile body; and (b) a seam extending through the projectile body and formed between the halves along the longitudinal mid-plane of the projectile body, the halves being joined to one another along the seam in any suitable manner, such as by a bond that is weaker in strength than the material making up the pair of halves of the projectile body such that the projectile body will separate at the seam along the longitudinal mid-plane into the halves upon impact with a target.

More particularly, the projectile body further has a substantially cylindrical rear portion and conical front portion. The rear and front portions of the projectile body each has a substantially circular cross-sectional configuration and the rear portion of the projectile body has a substantially uniform diameter. Also, the rear portion of projectile body can have a rear base that defines a concave recess. The front portion of the projectile body has a front tip, a rear end and a progressively decreasing diameter from the rear end to the front tip thereof. Also, the front tip of the front portion of the projectile body can have a concave recess typically known as a hollow point. Furthermore, each of the halves of the projectile body has a substantially flat inner surface being disposed adjacent to the longitudinal mid-plane of the projectile body. The relative weakness of the joint at the flat inner surfaces ensures that the dividing bullet upon impact with a target will divide into the two equal halves by separating along the mid-plane of the projectile body. Each projectile half produces a substantially uniform but separate wound channel and exit wound in the body of the target. The flat inner surfaces of the projectile half members create maximum resistance within the target body which makes larger wound channels therein.

Upon entering the target body, the projectile halves will separate and pivot away from one another so as to tumble and turn their respective flat inner surfaces from a substantially parallel position to the direction of travel wherein the flat inner surfaces substantially face toward one another so as to provide minimum resistance to travel through the target body, to a substantially transverse position to the direction of travel wherein the flat inner surfaces extend in facing relation with the target body so as to provide maximum resistance to their travel through the target body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a side elevational view of a preferred embodiment of a dividing bullet of the present invention having a projectile body with a seam formed along a longitudinal mid-plane thereof.

FIG. 2 is another side elevational view of the dividing bullet after rotation 90° about a longitudinal central axis of the projectile body relative to its orientation in FIG. 1.

FIG. 3 is a trailing end elevational view of the dividing bullet as seen along line 3—3 of FIG. 1.

FIG. 4 is a leading end elevational view of the dividing bullet as seen along line 4—4 of FIG. 1.

FIG. 5 is a cross-sectional view of the projectile body of the dividing bullet taken along line 5—5 of FIG. 1.

FIG. 6 is a cross-sectional view of the projectile body of the dividing bullet taken along line 6—6 of FIG. 1.

FIG. 7 is a longitudinal sectional view of the dividing bullet taken along line 7—7 of FIG. 2.

DETAILED DESCRIPTION OF THE INVENTION

Figures 11, 12:
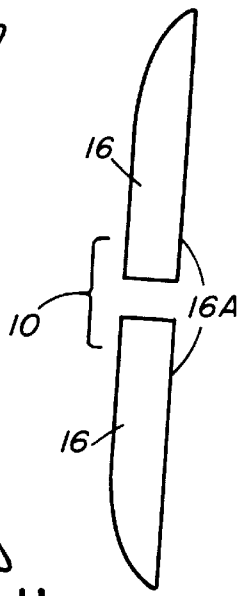
FIGS. 9 to 12 are a sequence of side elevational views of the dividing bullet progressively separating into its two projectile halves and tumbling after impact with and during penetration of the target.
Figure 10:
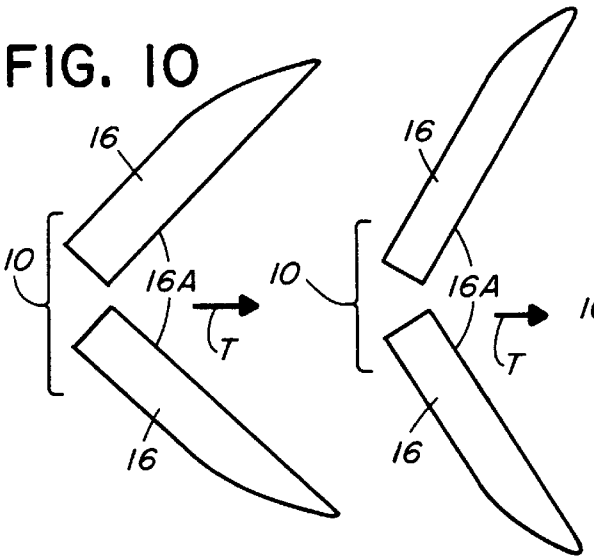

Referring to the drawings and particularly to FIGS. 1–7, there is illustrated a dividing bullet, generally designated 10, of the present invention. The dividing bullet 10 basically includes a projectile body 12 and a seam 14 through the projectile body 12. The projectile body 12 of the bullet 10 has a longitudinal mid-plane P and a pair of projectile halves 16. The projectile halves 16 are disposed on opposite sides of the longitudinal mid-plane P and are substantially symmetrical in relation to one another and to a longitudinal central axis A of the projectile body 12.

The seam 14 of the bullet 10 provides a plane of separation defined through the projectile body 12 and formed between the projectile halves 16 along the longitudinal mid-plane P of the projectile body 12. The halves 16 are joined to one another along the seam 14 in any suitable manner, such as by a., bond that is weaker in strength than the material making up the pair of halves 16 of the projectile body 12 such that the projectile body 12 will separate at the seam 14 along the longitudinal mid-plane P into the halves 16 upon impact with a target. However, the strength of the joint is sufficient to prevent separation of the halves 16 during travel through a gun barrel and flight to the target.

The projectile body 12 further has a substantially cylindrical rear portion 18 and a conical front portion 20 being integrally connected to one another. The rear and front portions 18, 20 of the projectile body 12 preferably have substantially circular cross-sectional configurations and, furthermore, the rear portion 18 of the projectile body 12 has a substantially uniform diameter. Also, the rear portion 18 of projectile body 12 at a rear base 22 can optionally have a concave indentation or recess 24 defined therein. The front portion 20 of the projectile body 12 has a front tip 26, a rear end 28 and a progressively decreasing diameter from the rear end 28 to the front tip 26 thereof. Also, the front tip 26 of the front portion 20 of the projectile body 12 can optionally have a concave recess 30 defined therein known as a hollow point. Furthermore, each of the halves 16 of the projectile body 12 has a substantially flat inner surface 16A disposed adjacent to the longitudinal mid-plane P of the projectile body P. The relative weakness of the joint at the flat inner surfaces 16A ensures that the dividing bullet 10 upon impact with a target will divide into the two equal halves 16 by separating along the mid-plane P of the projectile body 12. Each of the projectile halves 16 produces a substantially uniform but separate wound channel and exit wound in the body of the target. The flat inner surfaces 16A of the projectile halves 16 create maximum resistance within the target body which makes larger wound channels therein.

Thus, the dividing bullet 10 because of its symmetrical construction is accurate in flight because it is not lopsided nor will it wobble in flight. Each of the projectile halves 16 are of the same weight, shape and size and thereby are more accurate and effective in use. They produce a double wound channel that results in a stronger concussion, greater shock, and killing power.

Figure 15:
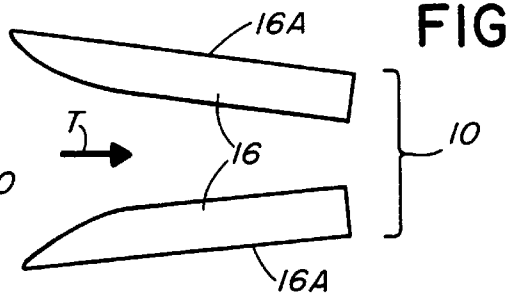
FIGS. 13 to 15 are a further sequence of side elevational views of the dividing bullet continuing to tumble during penetration of the target and completely reversing orientation.
Figure 9:
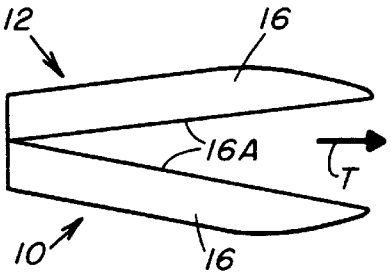
Figure 14:
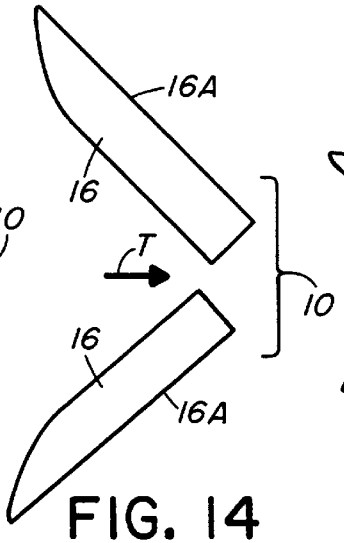
Figure 8:
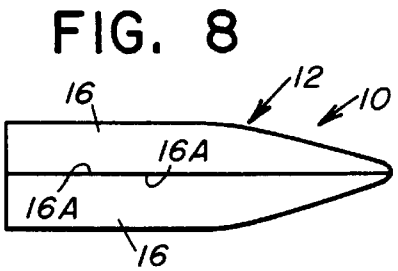
FIG. 8 is a side elevational view of the dividing bullet during flight before impacting a target.
Figure 13:
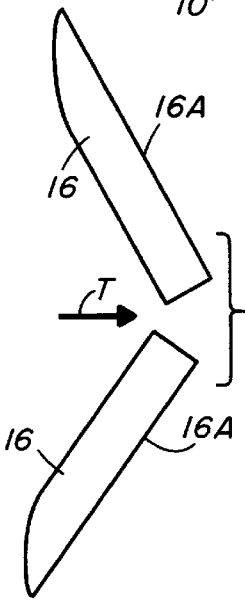

Referring now to FIGS. 8 to 15, upon entering the target body (not shown), the projectile halves 16 of the projectile body 12 will typically pivot away from one another so as to tumble and reorient their respective flat inner surfaces 16A from substantially parallel relation to the direction of travel T, as shown in FIG. 8, wherein the flat inner surfaces 16A substantially face toward one another so as to provide minimum resistance to travel through the target body, to a substantially transverse relation to the direction of travel T, as shown in FIG. 12, wherein the flat inner surfaces 16A extend in facing relation with the target body so as to provide maximum resistance to their travel through the target body. As the projectile halves 16 continue to tumble, as depicted in FIGS. 13 to 15, and completely turn around with their trailing ends now their leading ends, mushrooming may occur. The mushrooming effect is enhanced if the projectile halves 16 have indentations or recesses 24 in their originally trailing ends, as shown in FIGS. 1, 3 and 7. This mushrooming facilitate more damage with a double wound path through the target body.

To minimize fragmentation during travel toward and through the target body, the dividing bullet 10 is preferably made of a relatively high strength lead alloy that will deform or bend minimally so that upon striking the target body the dividing bullet 10 will separate into the two projectile halves 16 without fragmentation. Thus, each of the projectile halves 16 will penetrate deeper into the target body with a high probability of exiting and making the blood trail when wounding game.

The dividing bullet 10 can be made easily and cheaply by using well-known conventional machines and manufacturing techniques which would be readily known to those of ordinary skill in the art. Minimal or no fragmentation occurs because the lead alloy used is so much stronger than ordinary lead.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A dividing bullet, consisting essentially of:

(a) an elongated, first unitary projectile half being composed of at least one predetermined material, and having a predetermined size and shape, a longitudinal axis, a first planar surface defined by a continuous edge, and an essentially semi-circular cross-section in all planes transverse to said longitudinal axis; and (b) an elongated, second unitary projectile half being composed of the same at least one predetermined material as said first projectile half, and having a predetermined size and shape essentially identical to those of said first projectile half, a longitudinal axis, and a second planar surface defined by a continuous edge and an essentially semi-circular cross-section in all planes transverse to said longitudinal axis, said first and second projectile halves being bonded to one another by a second predetermined material which is disposed in between said first and second planar surfaces, said second predetermined material having a lower strength than said at least one predetermined material, thereby forming said bullet with said first and second planar surfaces positioned in substantially complete contacting relation to one another, thereby forming a seam therebetween and defining a longitudinal midplane, whereby, upon impacting a target, said bond will break and said first and second projectile halves will seperate from one another at said seam.

2. The dividing bullet of claim 1 wherein said bullet formed from said first and second projectile halves has a substantially cylindrical rear portion and a substantially conical front portion.

3. The dividing bullet of claim 2 wherein said rear portion of said bullet has a substantially uniform diameter.

4. The dividing bullet of claim 2 wherein said rear portion of said bullet has a rear base with a concave recess defined therein.

5. The dividing bullet of claim 2 wherein said front portion of said bullet has a front tip, a rear end and a progressively decreasing diameter from said rear end to said front tip thereof.

6. The dividing bullet of claim 5 wherein said front tip of said front portion of said bullet has a concave recess defined therein.

7. The dividing bullet of claim 1 wherein said pair of first and second projectile halves are made of a lead alloy of relatively higher strength than substantially pure lead.

8. A dividing bullet, consisting essentially of:

(a) a projectile body including a pair of projectile halves disposed on opposite sides of a longitudinal mid-plane extending through said projectile body, said halves being substantially symmetrical in relation to one another and to a longitudinal central axis of said projectile body, said halves having respective substantially flat inner surfaces facing toward and being in substantially complete contacting relation to one another, said projectile body having a rear portion of substantially cylindrical configuration and a front portion of substantially conical configuration; and (b) a seam extending through said projectile body and formed between said halves along said longitudinal mid-plane of said projectile body, said halves being joined to one another along said seam by a bond formed in between said flat inner surface of said halves by a predetermined material that is weaker in strength than the material making up said pair of halves of said projectile body, whereby upon impact with a target, said bond will break and said projectile body will separate at said seam along said longitudinal mid-plane into said halves.

9. The dividing bullet of claim 8 wherein said rear portion and said front portion of said projectile body each have a substantially circular cross-sectional configuration.

10. The dividing bullet of claim 8 wherein said rear portion of said projectile body has a substantially uniform diameter.

11. The dividing bullet of claim 8 wherein said rear portion of said projectile body has a rear base with a concave recess defined therein.

12. The dividing bullet of claim 8 wherein said front portion of said projectile body has a front tip, a rear end and a progressively decreasing diameter from said rear end to said front tip thereof.

13. The dividing bullet of claim 12 wherein said front tip of said front portion of said projectile body has a hollow point defined therein.

14. The dividing bullet of claim 8 wherein said pair of halves are made of a lead alloy of relatively higher strength than substantially pure lead.

* * * * *